United States Patent [19]

Hughes, Jr.

[11] 3,937,154

[45] Feb. 10, 1976

[54] AFTERBURNER APPARATUS FOR INCINERATORS OR THE LIKE

[75] Inventor: Carroll T. Hughes, Jr., Richmond, Va.

[73] Assignee: Consumat Systems, Inc., Richmond, Va.

[22] Filed: Aug. 28, 1974

[21] Appl. No.: 501,444

[52] U.S. Cl. ..... 110/8 A; 110/8 C; 23/277 C

[51] Int. Cl.[2] ..... F23G 5/12

[58] Field of Search ..... 110/8 R, 8 A, 8 C, 18 R, 110/18 C; 23/277 C

[56] References Cited

UNITED STATES PATENTS

| | | | |
|---|---|---|---|
| 3,491,707 | 1/1970 | Bakker | 110/8 |
| 3,563,188 | 2/1971 | Prosser et al. | 110/8 |
| 3,680,501 | 8/1972 | Szilagyi et al. | 110/8 |
| 3,782,301 | 1/1974 | Livengood et al. | 110/8 |
| 3,791,317 | 2/1974 | Schrage et al. | 110/8 |
| 3,807,321 | 4/1974 | Stockman | 110/8 |

*Primary Examiner*—Kenneth W. Sprague
*Attorney, Agent, or Firm*—Cushman, Darby & Cushman

[57] ABSTRACT

An afterburner apparatus to eliminate combustible products in exhaust gases so as to produce a substantially pollution-free gas for discharge to atmosphere. The afterburner apparatus is especially suitable for use with incinerators wherein the exhaust gases from the main combustion chamber oftentimes contain burnable waste products due to incomplete combustion. However, it may also be used with other types of combustion equipment, such as furnaces, gas heaters, or the like, wherein they, too, discharge exhaust gases having some burnable waste products therein. The afterburner apparatus provides for a more complete comsumption of waste products in that it is capable of obtaining a higher temperature in its combustion zone because heated air is supplied thereto to support combustion, the use of the heated air, resulting in a saving in the amount of fuel used to fire the combustion chamber. Ancillary to this, the heated air for the combustion chamber of the afterburner apparatus is heated by transfer of heat from already treated flue gases, and by not utilizing heat from the exhaust gases prior to their entry into the combustion chamber, these exhaust gases entering at a higher temperature, thus, making it easier to maintain the proper temperature in the combustion chamber.

20 Claims, 5 Drawing Figures

AFTERBURNER APPARATUS FOR INCINERATORS OR THE LIKE

The present invention relates to a new and improved system or apparatus for substantially eliminating or reducing pollution of atmosphere from exhaust gases, the apparatus being an afterburner arranged to receive exhaust gases having burnable or combustible waste products and burning such waste products and discharging a flue gas which is substantially pollution free and properly cooled. While the afterburner apparatus is especially adapted for use with incinerators where there is incomplete combustion of rubbish or waste products, it may be used with other primary combustion apparatus, such as furnaces or gas heaters, where there is a similar problem of incomplete combustion.

BACKGROUND OF THE INVENTION

Air pollution has become an acute problem in recent years, especially in areas of high density population wherein large amounts of rubbish and waste material must be disposed of by incineration. Since much of the rubbish and waste material is not biodegradable and, thus, cannot be buried where it would create other environmental problems in landfills and pollution of rivers, lakes, and other bodies of water, technology of incinerators has been increased with results that many incinerators made today reduce heavy smoke and other obnoxious waste discharged into the atmosphere, but these prior arrangements, while proving satisfactory to a certain extent, do not necessarily eliminate all of the harmful residues in the exhaust gases within standards set up by municipalities and/or the federal government. In those prior art incinerators which do meet such standards, they have been found to be costly to manufacture and also costly to operate.

Basically, the prior art incinerators and other primary combustion apparatus, such as furnaces, gas heaters, or the like, have utilized the concept of secondary burning in efforts to reduce the residual waste in the exhaust gases and this has been done by providing secondary spaced burning zone or zones in the exhaust stack of the incinerator. These prior art arrangements do provide for the supply of air into the secondary burning zone or combustion chamber so as to supply additional oxygen to support combustion, but such air was drawn from atmosphere and discharged into the secondary combustion chamber as subsequently "cool" air. This necessitated burners utilizing more fuel to maintain the heat in the secondary combustion zone or chamber at a temperature necessary for the combustion of waste products. In many instances, this heat in the combustion chamber of the afterburner could not be maintained at a sufficient temperature to cause complete combustion throughout the complete operation cycle of the equipment and in other instances, it could not be raised sufficiently high to burn certain waste products in the exhaust gases. U.S. Pat. No. 3,403,645, issued Oct. 1, 1968 to George H. Flowers, Jr., and U.S. Pat. No. 3,489,109, issued Jan. 13, 1970 to George H. Flowers, Jr., and both assigned to the same Assignee as this application, disclose incinerators which utilize a two-stage combustion process for producing clean flue gases. In the first stage, burning of the bulk of the waste material is accomplished in a primary or main combustion chamber and the hot exhaust gases are discharged from this chamber into a second combustion chamber wherein additional air is supplied direct from atmosphere to further support the burning of any combustible products left in the exhaust gases. While the arrangements disclosed in these two patents do result in satisfactory elimination of air pollution for many waste materials, the temperatures within the secondary combustion chamber could not be raised high enough to support combustion of certain waste products without constantly utilizing the burner therein and this resulted in an expensive operation and the lack of conservation of fuel.

U.S. Pat. 3,408,167, issued Oct. 29, 1968 to Roy W. Burden, Jr., discloses an exhaust gas afterburner essentially for use with incinerators or other primary combustion devices, the afterburner being positioned in the stack or in a bypass portion of the stack. In the arrangement of the aforementioned patent, a burner is provided in an area where combustion is to take place and upstream of the burner and the burning zone or combustion chamber there is provided means for introducing air into the exhaust gases in a turbulent manner. While this arrangement is somewhat analogous to the aforementioned Flowers patents, it again utilizes atmospheric air for assisting in combustion and this air is substantially cool air which has not been purposely heated. Another difficulty in this particular arrangement is that air is introduced upstream of the burner area and, consequently, the air has a tendency to cool the exhaust gases, thus, necessitating a requirement for use of even more fuel in the burner to elevate the temperature in the combustion chamber to a temperature sufficient to burn the waste products from the exhaust gases. U.S. Pat. No. 3,511,224, issued May 12, 1970 to Samuel R. Powancher, discloses a smokehouse exhaust incinerator wherein exhaust gases from a smokehouse are mixed with fresh air and are discharged together into a combustion chamber having a burner. The incinerator of this latter-mentioned patent is somewhat similar to that of the Burden patent in that, again, there is a cooling of the exhaust gases prior to entry into the combustion chamber by mixture with air with this resulting in the disadvantages mentioned heretofore. Of course, in this arrangement, the purpose is to burn the exhaust gases to remove the smoke therefrom and, consequently, the temperatures necessary for this type of operation are not nearly as high as those temperatures required for burning waste products in exhaust gases where such waste products come from either solid or liquid waste or rubbish and wherein such waste material being burned is not biodegradable.

BRIEF DESCRIPTION OF THE PRESENT INVENTION

The present invention provides an improved combustion apparatus for burning combustible waste products in exhaust gases received from a primary combustion zone. By the use of heated air injected into the combustion chamber wherein there is a burner, temperatures within said combustion chamber can be raised to a point where substantially all of the combustible waste products in the exhaust gases can be burned so that the flue gases discharged from the combustion chamber are substantially pollution free.

More specifically, the present invention provides an improved afterburner apparatus for producing substantially pollution-free flue gases, the apparatus comprising a combustion chamber having an inlet for exhaust gases with burnable waste products adjacent one end thereof and an outlet adjacent the other end thereof for discharging the substantially pollution-free flue gases. The combustion chamber is provided with burner means at the end adjacent the inlet for injecting fuel therein and with stack means extending from the outlet for discharging the flue gases to atmosphere. Means are provided for supplying heated air to the combustion chamber to assist the burner means in igniting the waste products in the exhaust gases and to assist in the support of combustion in the combustion chamber with or without the burner means operating, the means for supplying heated air utilizing means to transfer heat from the substantially pollution-free flue gases downstream of the combustion chamber and in the stack whereby the temperatures of the flue gases are also materially reduced.

Ancillary to the above, the afterburner apparatus is contemplated as being used with an incinerator for disposing of waste material, either solid or liquid, or a combination of both, the incinerator including a main combustion chamber and the afterburner as a secondary combustion chamber, the afterburner being between the stack means and the main combustion chamber.

The invention provides for additional cooling of the stack means downstream of the heat transfer unit for heating the air from the flue gases, thus, the flue gases are further cooled prior to being discharged to atmosphere, thus, resulting in shorter stack means or stack means with refractory material therein extending only part way up the same.

The invention also provides for increasing the rate of flow of air after the air has been heated and the discharge of this heated air at discrete openings in the combustion chamber whereby turbulence is created in the combustion chamber to provide for full burning of the combustible waste products in the exhaust gases.

Throughout this specification, the term "exhaust gases" refers to those gases leaving a primary combustion zone or chamber and prior to the gases being treated for removal of residue of combustible products. On the other hand the term "flue gases" refers to those gases leaving the secondary combustion zone or chamber and in which the combustible waste products have been burned.

DETAILED DESCRIPTION OF THE INVENTION

Figures 2, 3:
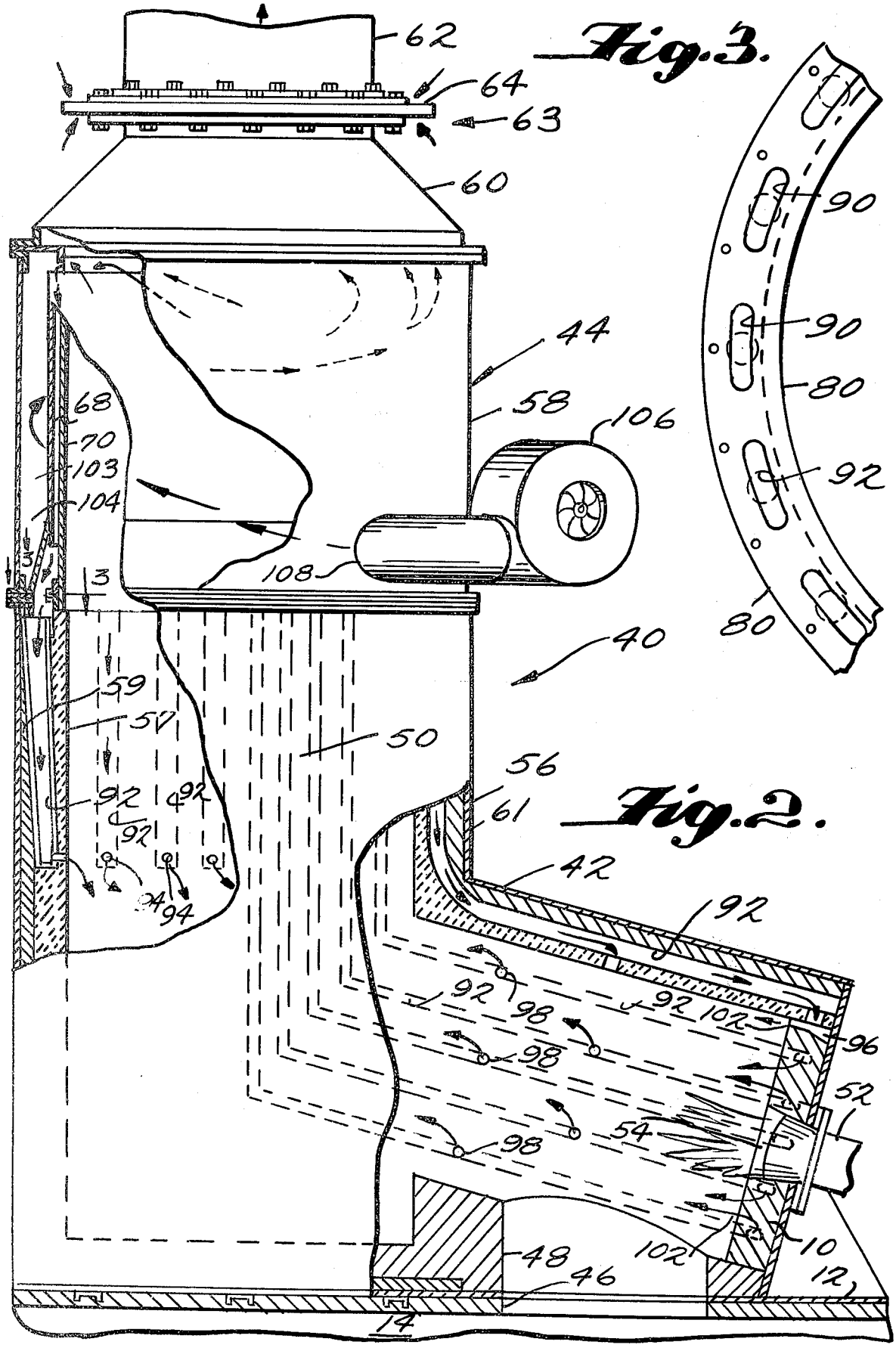
FIG. 2 is an enlarged fragmentary diagrammatical view, partly in elevation and partly in vertical section, the view illustrating the features of the present invention and being from the opposite side of FIG. 1.
FIG. 3 is a fragmentary view taken substantially in the direction of the arrows 3—3 shown in FIGS. 2 or 4, the view illustrating an arcuate segment of the connecting ring.

Referring to the drawings wherein like characters or reference numerals represent like or similar parts, a controlled air incinerator for the present invention is generally designated by the reference numeral 10. The incinerator 10 includes an annular casing 12 provided with a suitable refractory lining and insulation, the annular casing 12 having a substantially horizontal axis. The annular casing 12 defines a main primary combustion chamber with a main or primary combustion zone 14 (FIG. 2). At least one or more pressure burners 16, which may be gas or fuel burners, have nozzles within the main combustion chamber 12 for starting the burning of waste products. These pressure burners 16 are supplied with air to their nozzles (not shown) by means of an air blower 18 through the manifold 20 and the conduits 22. The burners 16 are normally turned off by suitable temperature responsive control devices once the combustion has been started and controlled temperatures within the main combustion chamber are reached. In order to support combustion during starting and once the waste material has started to burn, a further manifold 24 supplies air through a plurality of apertures (not shown) into the interior of the main combustion chamber 12, the manifold being supplied with air under pressure from an air blower 26. The arrangement of the main combustion chamber 12 is generally of the type disclosed in the aforementioned U.S. Pat. No. 3,489,109.

Incinerator 10, at one end thereof, is provided with a rectangular annular extension 28 and a fire door generally designated at 30. Outwardly of the fire door 30 there is provided an automatic waste loading device generally designated at 32 and this device may be of the type disclosed in the co-pending U.S. application of Carroll T. Hughes, Jr. and James K. Fishback, serially numbered 405,079. The loading device 32, through a suitable control system, loads the waste material through the open fire door into the main combustion chamber 12. This will move the burning waste material toward the left of FIG. 2 where the ash, after combustion of the waste material, can be removed.

The opposite end of the casing or main combustion chamber 12 is provided with an access door 34 which may be of the type disclosed in the aforementioned U.S. Pat. No. 3,489,109. When the incinerator is not being used, the door 34 provides access for cleaning out the interior and/or making repairs thereto. Additionally, the opposite end may be provided with an automatic ash removal device, generally designated at 36, of the type disclosed in the aforementioned U.S. application Ser. No. 405,079. This automatic ash removal device may discharge ashes into an endless take-off conveyer 38 or it may discharge such ashes into ash receiving carts or the like provided in a pit for the same.

The incinerator 10 further includes a novel afterburner apparatus generally designated at 40, the afterburner apparatus comprising a secondary combustion chamber 42 and stack means 44 cooperating with the secondary combustion chamber 42. The purpose of the afterburner apparatus 40 is similar to the secondary combustion chambers of the aforementioned U.S. Pat. Nos. 3,403,645 and 3,489,109 in that it receives hot exhaust gases having combustible waste products therein from the main combustion chamber 12 and provides a secondary stage of burning for burning the combustible waste products so that the resulting flue gases traveling up the stack means and discharged to the atmosphere are generally pollution free as substantially all of the pollution particles or products have been removed therefrom. However, the afterburner apparatus 40 and its secondary combustion chamber 42 operate a far more efficiently as the temperatures in the secondary combustion chamber 42 are elevated to a considerably higher range than those of the prior art. Ancillary to this, the afterburner apparatus 40 is also more efficient in that it requires less fuel for its pressure burner 52 to raise and maintain the temperatures therein to any desired range.

Figure 1:
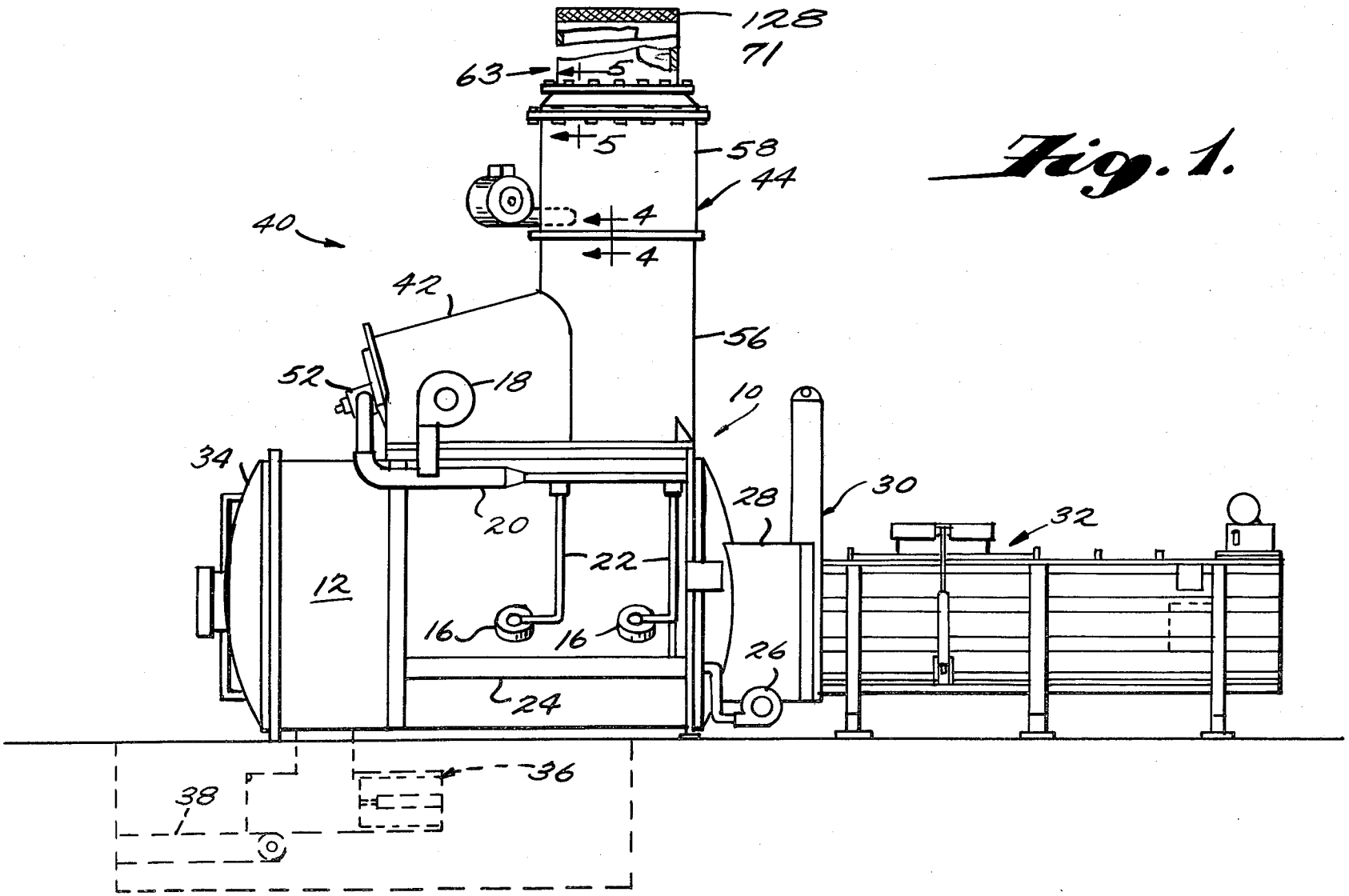
FIG. 1 is a side elevational view of an incinerator incorporating the afterburner apparatus of the present invention.

More particularly, and referring specifically to FIG. 2, it will be noted that the main combustion chamber 12 is provided with an outlet 46 for the flow of waste and pollution-containing exhaust gases therefrom, the outlet 46 communicating with an inlet 48 of the secondary combustion chamber 42. The secondary combustion chamber 42 communicates with the lower end of the stack means at 50 and discharges upwardly therefrom the substantially pollution-free flue gases. At one end of the secondary combustion chamber there is provided a pressure burner 52 which may be supplied fuel such as gas and/or oil just as the burners 16, the burner 52 also being supplied with the necessary air for mixture with the fuel from the blower 18 through the manifold 20 (FIG. 1). The pressure burner 52 has a nozzle 54 which directs its flame in a direction parallel to the longitudinal axis of the secondary combustion chamber 42, which axis is transverse to and intersects the vertical axis of the stack means 44.

Referring now to the stack means 44, it will be noted that the stack means is provided with a lower portion 56 communicating with the secondary combustion chamber 42 at 50, the portion 56 being refractory lined at 57 and provided with suitable insulation at 59. The entire lower portion 56 is provided with an exterior steel shell 61 and it will be noted that this lower portion 56 may be made as a unit with the secondary combustion chamber 42. A heat exchanger portion 58 is connected to the upper end of the lower portion 56 and this heat exchanger portion will be described in more detail later in the specification. Above the heat exchanger portion 58 there is an upper portion 63 comprising a frusto-conical portion 60 which terminates in a generally cylindrical discharge portion 62. The frusto-conical portion 60 is refractory lined, as indicated at 65, and also insulated as indicated at 67, the portion 60 also having an exterior steel shell 69 (see FIG. 5). At least the lower section of the discharge portion 62 is refractory lined, as indicated at 71, and covered with a steel shell 73. Intermediate the frusto-conical portion 60 and the discharge portion 62, means 64 are provided for the draft of atmospheric air into the upwardly flowing flue gases, this means providing secondary cooling of the flue gases in addition to the primary cooling of the flue gases as a result of the heat exchanger portion 58.

Figure 4:
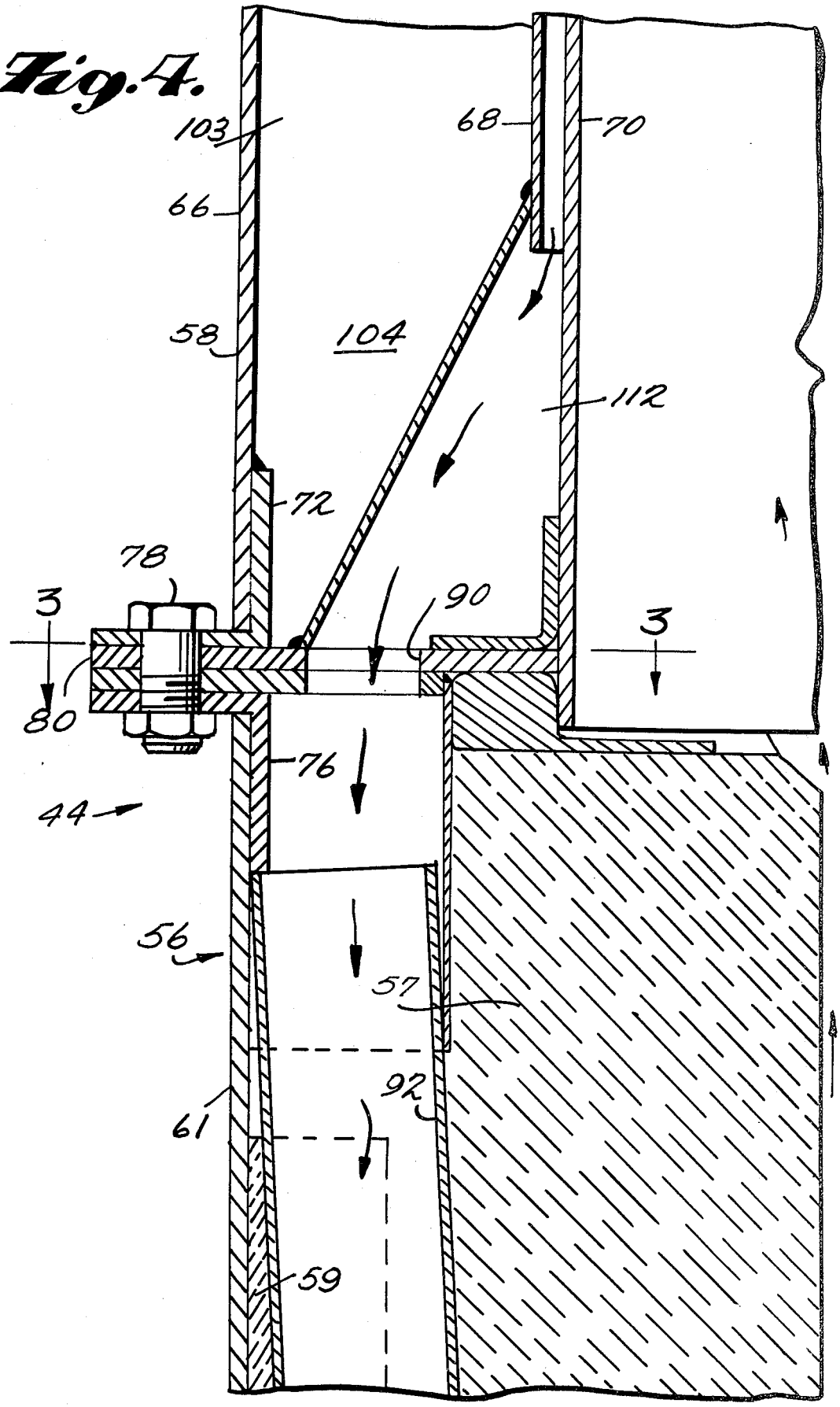
FIG. 4 is an enlarged fragmentary sectional view taken on the line 4—4 of FIG. 1.
Figure 5:
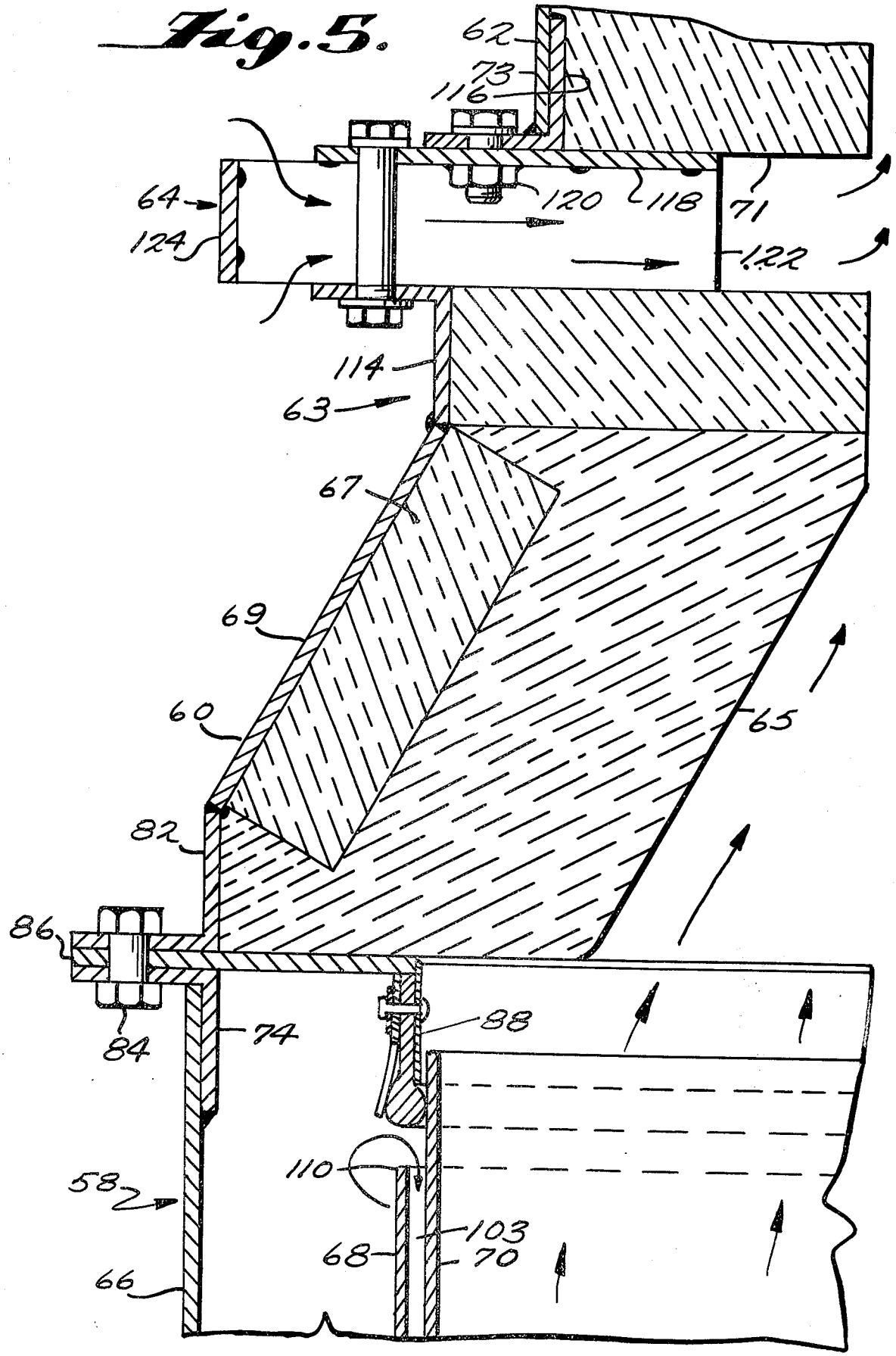
FIG. 5 is an enlarged fragmentary sectional view taken on the line 5—5 of FIG. 1.

Referring now specifically to FIGS. 2, 4, and 5, the heat exchanger portion 58 of the stack means 44 includes three substantially concentric walls, an outer wall 66, a spaced intermediate wall 68, and a spaced inner wall 70. The intermediate wall 68 and inner wall 70 are made from stainless steel because they are subjected to high temperatures, whereas the outer wall may be made of rolled steel. The outer wall 66 is provided with annular L-shaped flanges 72 and 74 at its lower and upper ends, respectively, the flanges having radially extending legs and being utilized to couple the heat exchanger portion 58 to the lower portion 56 and upper portion 63, respectively, of the stack means 44. As shown in FIG. 4, the steel shell 61 of the lower portion 56 of the stack means 44 is provided at its upper end with an annular L-shaped flange 76 and it is bolted to the flange 72 by bolt means 78, there being two annular apertured plates 80 therebetween. On the other hand, the shell 69 of the frusto-conical portion 60 of the upper portion 63 is provided with an annular L-shaped flange 82 and it is bolted to the flange 74 by bolts 84, there being a solid annular plate 86 therebetween. The annular plate 86 has attached to its inner periphery a tadpole-type of seal 88 for sealing against the upper end of the inner wall 70 of the heat exchanger portion 58. Further, it will be noted that the inner wall 70 extends upwardly further than the intermediate wall 68.

The annular plates 80, as shown in FIG. 3, are provided with a plurality of elongated circumferentially extending apertures 90 therein which communicate with a plurality of spaced passages 92 extending through the refractory lining 57 of the lower portion 56 of the stack means 44. Some of the circumferentially spaced passages 92 extending through the lower portion 56 on the portion thereof furthest from the nozzle 54 of the pressure burner 52 terminate in discrete openings 94 just inside the secondary combustion chamber 42, whereas other of the passages 92 extend downwardly through the lower portion 56 and then along the length of and through the refractory lining of the secondary combustion chamber 42 and terminate in an arcuate chamber 96 surrounding the nozzle 54 of the pressure burner 52. Those passages 92 which extend down through the refractory lined wall of the secondary combustion chamber 42 also have discrete openings 98 along the length of the secondary combustion chamber 42, whereas the arcuate chamber 96 formed by the end wall refractory material 100 is provided with an arcuate opening 102 which directs air into the secondary combustion chamber 42 in a direction parallel to the axis of the same and parallel to the direction of the flame produced by the nozzle 54.

The outer wall 66, intermediate wall 68, and inner wall 70 define a continuous annular passage with the lower portion 104 of the passage 103 being in communication with a blower 106 having a tangential inlet 108 thereto. Referring to FIGS. 2, 4, and 5, it will now be appreciated that when the blower 106 is operating, it forces air into the passage 103 circumferentially and this air travels upwardly and around in the annular space between the walls 66 and 68 and over the upper edge 110 of the wall 68 and then downwardly between the spaced walls 68 and 70. The tadpole-type seal 88 prevents this air from escaping into the main passageway of the stack means. When the air reaches the lower portion of the passage 103 between the walls 68 and 70, as indicated at 112 in FIG. 4, it passes through the individual apertures 90 in the annular plates 80 and is divided into the individual passages 92 in the lower portion 56 of the stack means 44 to be ultimately discharged through the discrete openings 94, 98, and 102. The air passing through the openings 94 and 98 into the secondary combustion chamber 42 creates turbulence within the chamber, whereas the air passing through the opening 102 gives impetus to the flow of exhaust gases from the main combustion chamber 12 in a direction of the longitudinal axis of the secondary combustion chamber.

The frusto-conical portion 60 of the upper stack portion 63 is an air inducement cone for drawing air through the air induction means 64. In more detail, the upper end of the shell 69 is provided with an annular L-shaped flange 114, whereas the lower end of the discharge portion 62 is provided with an annular L-shaped flange 116. Intermediate these two flanges there is provided a section which includes an annular plate member 118 bolted to the flange 116 by bolt means 120, the plate member being provided with a plurality of radially extending sections or ribs 122. The outer ends of the sections or ribs 122 are secured to an annular ring 124, this ring being spaced from the edge of the plate member 118 and the outermost edge of the flange 114 so that air can travel between the spoke-like sections or ribs 122 into the stack when the stack is discharging flue gases upwardly.

Briefly, the operation of the incinerator of the present invention is as follows. First, the main combustion chamber 12 is loaded with material to be burned and the burners 16 are ignited to initiate combustion of the waste material with air being supplied to the interior of the main combustion chamber 12 from the blower 26 and manifold 24. Exhaust gases will begin to discharge through the opening 46 of the main combustion chamber into the inlet 48 of the secondary combustion chamber 42 and just prior to this time, the burner 52 is started, as well as the blower 106.

In a typical operation, temperature in the main combustion chamber will reach 1500°F. to about 2000°F., depending on the type of waste material being burned, and will be discharged at this temperature into the secondary combustion chamber. Once a stabilized temperature has been reached in the main combustion chamber 12, the burners 16, which may be controlled by temperature responsive control devices, are turned off and air is supplied by the manifold 24 on demand to the interior of the main combustion chamber 12 to support combustion therein. The pressure burner 52 for the secondary combustion chamber 42 initiates combustion therein of combustible waste products in the exhaust gases entering and the temperature in this chamber begins to rise due to this combustion and the supply of heated air thereto. Flue gases will be discharged upwardly above the openings 94 of the secondary combustion chamber 42 and along the inner wall 70 of the heat exchanger portion 58 of the stack means 44, heating up the wall 70. Temperatures of the flue gases leaving the secondary combustion chamber 42 will be in the order of 2200°F. to 2800°F. and, as will now be appreciated, the air entering the passage 103 and flowing circumferentially upwardly in this passage between the walls 66 and 68 will begin to heat and will be further heated as it flows downwardly between the walls 68 and 70. Air, for example, enters from the blower at about 60°F. and where the air passes over the top edge of the wall 68 and down through the passage 103 between the walls 68 and 70, the temperature will have reached to approximately 150°F. By the time the air reaches the point at the lower end of the passage 103 where it is discharged into the individual passages 92, it will have reached approximately 400°F. At the point of discharge from the openings 102, the air has reached 500°F. and, thus, it easily supports combustion within the secondary combustion chamber 42. The temperatures vary from 400°F. to 500°F. when it is discharged through the other openings 94 and 98 and, yet, this is still high enough to materially assist in the combustion of the waste products in the exhaust gases in the secondary combustion zone.

As will be understood, the blower 106 may be a five horsepower blower delivering 1200 cubic feet per minute of air at eight inches water column. This air flows slowly upwardly between the walls 66 and 68 and passes through the restricted portion of the passage 103 between the walls 68 and 70 where its velocity increases to between 3000 and 6000 feet per minute. It reduces somewhat when it is flowing in the individual passages 92 and this velocity is between 2000 and 4000 feet per minute, but since the air is discharged through the small discrete openings 94, 98, and 102, its velocity of discharge is between 4000 and 10000 feet per minute and, thus, it creates considerable turbulence within the secondary combustion chamber 42 so that there can be substantially complete combustion of all waste products in the exhaust gases.

By providing such an arrangement as just described, the pressure burner 52 requires less fuel to initiate combustion and once combustion has been initiated, the burner 52 may be turned off by suitable temperature responsive control devices. Since the air entering the secondary combustion chamber 42 is heated to extremely high temperatures prior to entering the combustion chamber, this air will be sufficient to maintain the proper temperatures once the system is in operation.

By providing the heat exchange portion 58 downstream of the secondary combustion chamber 42, the heat removed or transferred from the flue gases is utilized and, thus, there is no reduction in the temperature of the exhaust gases entering the secondary combustion chamber 42 and, consequently, there is a saving of fuel.

The provision of the air induction means 64 downstream of the heat exchange portion 58 of the stack means 44 provides auxiliary cooling of the flue gases so that a shorter upper portion 63 may be used and this upper portion does not necessarily have to be lined with the 71 refractory material extending all the way to the top screened discharge opening 128 where the flue gases are discharged into the atmosphere.

The terms used throughout this specification are for the purpose of description and not limitation, the scope of the invention being defined by the appended claims.

What is claimed is:

1. An incinerator for disposing of waste material comprising:

a main combustion chamber for receiving and burning of waste material;

a secondary combustion chamber operatively connected to said main combustion chamber for receiving exhaust gases therefrom and burning waste products in the exhaust gases to produce substantially pollution-free flue gases, said secondary combustion chamber having a pressure burner therefor with a burner nozzle therein at least for assisting in the starting of the burning of waste products in the exhaust gases;

stack means operatively connected to said secondary combustion chamber for receiving flue gases therefrom and discharging the same to atmosphere;

and means for supplying air under pressure into said secondary combustion chamber to assist in the support of combustion therein, said last-mentioned means including means for at least heating the air by heat transferred from flue gases downstream of said secondary combustion chamber prior to entry of the air into said secondary combustion chamber, said air supply means including a blower and said means for heating said air including a passageway in said stack means operatively connected to said blower and discharging into said secondary combustion chamber at discrete openings;

at least a first portion of said stack means adjacent said secondary combustion chamber being refractory lined, said secondary combustion chamber being refractory lined, and at least another portion of said stack means downstream of said first portion including three annular walls comprising an outer wall member, an intermediate wall member, and an inner wall member, the intermediate wall member and the inner wall member being heat transfer members and the three wall members defining a portion of said passageway for air under pressure, the other portion of said passageway being defined by individual passages through said refractory lined first portion of said stack means terminating in said discrete openings in said secondary combustion chamber.

2. An incinerator as claimed in claim 1 including air inlet means for said stack means positioned downstream of said means for heating the air from flue gases, said air inlet means providing ambient air to said flue gases for further cooling the same.

3. An incinerator as claimed in claim 1 in which said blower supplies air tangentially between the outer wall member and intermediate wall member with the air being directed circumferentially upwardly between the two and downwardly between the inner wall member and the intermediate wall member to the individual passages.

4. An incinerator as claimed in claim 3 in which at least the inner wall member and intermediate wall member are made of stainless steel.

5. An incinerator for disposing of waste material comprising:

a main combustion chamber for receiving and burning of waste material;

a secondary combustion chamber operatively connected to said main combustion chamber for receiving exhaust gases therefrom and burning waste products in the exhaust gases to produce substantially pollution-free flue gases, said secondary combustion chamber having a pressure burner therefor with a burner nozzle therein at least for assisting in the starting of the burning of waste products in the exhaust gases;

stack means operatively connected to said secondary combustion chamber for receiving flue gases therefrom and discharging the same to atmosphere, said stack means having a substantially vertical axis and said secondary combustion chamber having a longitudinal axis extending transversely of said vertical axis, said secondary combustion chamber having an end wall remote from said stack means and in which said burner nozzle is positioned;

and means for supplying air under pressure into said secondary combustion chamber to assist in the support of combustion therein, said last-mentioned means including means for at least heating the air by heat transferred from flue gases downstream of said secondary combustion chamber prior to entry of the air into said secondary combustion chamber, said air supply means including a blower and said means for heating said air including passageway in said stack means operatively connected to said blower and discharging into said secondary combustion chamber at discrete openings;

at least some of said discrete openings of said passageway being in said end wall and opening into said combustion chamber for supplying heated air thereto in a direction substantially parallel to the longitudinal axis of said combustion chamber.

6. An incinerator as claimed in claim 5 in which at least some other of said discrete openings open into said secondary combustion chamber along its length for discharging heated air into said secondary combustion chamber to cause turbulence in said secondary combustion chamber during burning of waste products in exhaust gases.

7. An incinerator as claimed in claim 6 in which the lower end of said stack means opens into said secondary combustion chamber above the at least discrete openings which are furthest remote from said end wall of said secondary combustion chamber.

8. An incinerator as claimed in claim 7 in which said stack means includes a first portion adjacent said secondary combustion chamber which is refractory lined, a second portion immediately above said first portion, said second portion including three annular walls comprising an outer wall member, an intermediate wall member, and an inner wall member, the intermediate wall member and the inner wall member being heat transfer members and the three wall members defining a portion of the passageway for air under pressure, the other portion of said passageway being defined by individual passages through the refractory lined first portion of said stack means and terminating in said discrete openings in said secondary combustion chamber.

9. An incinerator as claimed in claim 8 in which said blower supplies air tangentially between the outer wall member and the intermediate wall member adjacent the lower portion of the same with the air being directed circumferentially upwardly between the two wall members and downwardly between the inner wall member and the intermediate wall member into the individual passages.

10. An incinerator as claimed in claim 9 in which at least the inner wall member and the intermediate wall member are made of stainless steel.

11. An incinerator as claimed in claim 10 in which the air entering the individual passages is heated in said second portion of said stack means to at least 400°F. and is further heated to at least 500°F. when in said individual passages and prior to discharge through said discrete openings.

12. An incinerator as claimed in claim 11 in which exhaust gases with burnable waste products enter said secondary combustion chamber at a temperature of at least 1500°F. and in which flue gases leave said secondary combustion chamber at least 2200°F.

13. An incinerator as claimed in claim 12 in which said stack means includes a third portion above said second portion, said third portion being refractory lined at least adjacent to said second portion.

14. An incinerator as claimed in claim 13 including air inlet means for said stack means positioned in said third portion above said second portion, said air inlet means providing ambient air to said flue gases for further cooling the same prior to discharge from said third portion.

15. An afterburner apparatus for burning burnable waste products in exhaust gases to produce substantially pollution-free flue gases comprising:

a combustion chamber having an inlet for exhaust gases with burnable waste products adjacent one end thereof and an outlet adjacent the other end thereof for discharge of the substantially pollution-free flue gases, said combustion chamber having burner means at the one end adjacent the inlet for injecting fuel therein generally in a direction of a longitudinal axis of the combustion chamber;

stack means extending from the outlet of said combustion chamber for discharging the substantially pollution-free flue gases to atmosphere, said stack means including a refractory lined lower portion extending from the outlet of said combustion chamber, a heat exchanger portion connected to said lower portion, and an upper portion for discharging flue gases to atmosphere;

means for supplying heated air to said combustion chamber to assist said burner means in igniting the waste products in the exhaust gases and to assist in the support of combustion in the combustion chamber with and without the burner means operating, said means for supplying heated air including means for utilizing the transfer of heat from flue gases downstream of said combustion chamber and in said stack means whereby temperature of flue gases is materially reduced, said means for supplying heated air to said combustion chamber including a blower, a passageway for air extending through said heat exchanger portion, and through said lower portion and terminating in discrete openings in said combustion chamber.

16. An afterburner apparatus as claimed in claim 15 in which said heat exchanger portion of said stack means includes three substantially concentric annular walls defined by an outer wall, an intermediate wall, and an inner wall, said blower being arranged to supply air tangentially into an outer annular passage defined by the outer wall and the intermediate wall to cause air to flow upwardly and circumferentially therearound and downwardly through an inner annular passage defined by the intermediate wall and the inner wall, and a plurality of passages extending from said inner annular passage through the refractory lined lower portion of said stack means and terminating in said discrete openings, said passages receiving the downwardly flowing air and further heating the same.

17. An afterburner apparatus as claimed in claim 16 including air inlet means in said upper portion of said stack means where air can be drawn into the said stack means to further cool the flue gases after the flue gases have passed from the said heat exchanger portion of said stack means.

18. An afterburner apparatus as claimed in claim 17 in which at least some of said discrete openings for air direct air into said combustion chamber in a direction parallel to the axis of the same.

19. An afterburner apparatus as claimed in claim 18 in which other of said discrete openings for heated air are arranged to direct air into said combustion chamber in a direction transverse to flow therethrough to thereby create turbulence in the burning zone of the combustion chamber.

20. An afterburner apparatus as claimed in claim 16 in which said inner wall and said intermediate wall are made from a stainless steel material.

* * * * *